United States Patent [19]

Fruchter

[11] Patent Number: 4,475,654

[45] Date of Patent: Oct. 9, 1984

[54] STORAGE AND INDIVIDUALIZED DOSAGE CONTAINER

[76] Inventor: Lawrence C. Fruchter, 151 W. 13th ST., New York, N.Y. 10011

[21] Appl. No.: 535,120

[22] Filed: Sep. 23, 1983

Related U.S. Application Data

[63] Continuation of Ser. No. 68,792, Aug. 22, 1979, abandoned.

[51] Int. Cl.[3] ..... B65D 85/56; B65D 83/04

[52] U.S. Cl. ..... 206/538; 206/540; 206/457; 220/23; 220/345; 220/375

[58] Field of Search ..... 206/538, 540, 457; 220/23, 21, 345, 375

[56] References Cited

U.S. PATENT DOCUMENTS

| | | | |
|---|---|---|---|
| 3,332,586 | 7/1967 | Amburgey | 220/345 |
| 3,367,484 | 2/1968 | Nelson | 220/21 |
| 3,446,179 | 5/1969 | Bender | 220/23 |
| 4,036,357 | 7/1977 | Czelen | 220/375 |
| 4,165,815 | 8/1979 | Vetter | 220/23 |

*Primary Examiner*—William T. Dixson, Jr.
*Attorney, Agent, or Firm*—E. J. Berry

[57] ABSTRACT

A storage and individualized dosage container for pills, tablets and the like consists essentially of a hollow storage receptacle and a closure cap. The receptacle terminates at its upper extremity in an open mouth. The closure cap includes a bottom wall and sidewalls which together define a compartment dimensioned to contain pills, tablets, etc. of the type stored within the receptacle in lesser quantity. The bottom and sidewalls of the closure cap are proportioned and possess sufficient rigidity such that the closure cap is insertable as a plug into the mouth of the receptacle to selectively seal the same. The closure cap has an opening formed therein at a location remote from its bottom wall. A lid is integral with the closure cap and is movable selectively relative to the opening therein to either close the opening or expose it to provide access to the contents of the compartment in the closure cap.

2 Claims, 5 Drawing Figures

STORAGE AND INDIVIDUALIZED DOSAGE CONTAINER

The present application is a continuation of copending application Ser. No. 068,792, filed Aug. 22, 1979, now abandoned.

BACKGROUND OF THE INVENTION

The present invention relates to storage containers for pills, tablets and the like and more particularly to a device of this general character which is also capable of storing individualized dosages of such consumables.

A variety of devices have been known heretofore for storing medicinal, vitamin and similar pills, tablets, capsules, etc. and for dispensing such container contents, usually one at a time. U.S. Pat. No. 2,886,208, granted May 12, 1959 to H. J. Sinclair, for example discloses a representative device of this type in which pills are metered past a dispenser for discharge one at a time. U.S. Pat. No. 2,953,242, granted Sept. 20, 1960 discloses a container for pills, tablets and the like for making available such articles in prescribed dosage quantities and at desigated times. The device comprises a container having a plurality of compartments and a pair of superimposed discs each of which is rotatable relative to the container and to each other. Apertures are provided in the discs which are alignable to permit removal of the pills from the container compartments selectively. U.S. Pat. No. 3,446,179, granted May 27, 1969 to S. Bender, discloses a dosage time indicator closure for a bottle such as a medicine bottle. The closure includes an auxilliary pill-holding compartment and a separate cover for such compartment. The cover is provided with indicating means thereon which is cooperable with time indicia carried by a shoulder on the pill-receiving portion to afford a visual record of when the dosage of pills within the auxilliary compartment is to be consumed.

The prior devices of the types discussed are generally structurally complex, hence relatively expensive to manufacture and, therefore, limiting their acceptance by the public. Additionally, as in the case of the device shown in the Bender patent, the closure cap is fabricated in two or more sections which must be physically separated before access to the prescribed dosage of pills can be gained. Since the containers are destined for use frequently with aged or infirm persons it is not uncommon for one of the closure cap sections to be misplaced temporarily or lost thereby negating much of the utility of such devices.

SUMMARY OF THE INVENTION

It is one object of this invention to provide a storage and individualized dosage container for pills, tablets and the like which is of simple yet rugged construction facilitating mass production.

It is another object of the invention to provide a storage and individualized dosage container for pills, tablets and the like having a closure cap with an integral lid of its own which is not subject to being misplaced or lost.

It is yet another object of the invention to provide a storage and individualized dosage container for pills, tablets and the like which can readily and simply be checked to ascertain whether or not the prescribed dosage of medication or vitamins have been taken.

Other objects and advantages of the invention will become readily apparent to persons versed in the art to which the invention pertains from the ensuing description thereof.

In accordance with the invention there is provided a storage and individualized dosage container for pills, tablets and the like comprising a hollow storage receptacle having a bottom wall and sidewalls terminating at their upper extremities in an open mouth; and a closure cap including its own bottom wall and sidewalls which, together with the bottom wall, define a compartment dimensioned to contain a quantity of pills or tablets of the type stored within the receptacle but in a lesser quantity, the bottom and sidewalls of the closure cap being proportioned and possessing sufficient rigidity such that the closure cap is insertable as a plug into the mouth of the receptacle to selectively seal same, an opening being formed in the closure cap at a location remote from its bottom wall, the closure cap also including a lid integral therewith and movable selectively in relation to the opening in the cap whereby the opening may be sealed or exposed to provide access to the contents of the compartment.

BRIEF DESCRIPTION OF THE DRAWINGS

In order that the invention may be more fully comprehended it will now be described, by way of example, with reference to the accompanying drawings in which.

DESCRIPTION OF THE PREFERRED EMBODIMENTS

Figure 1:
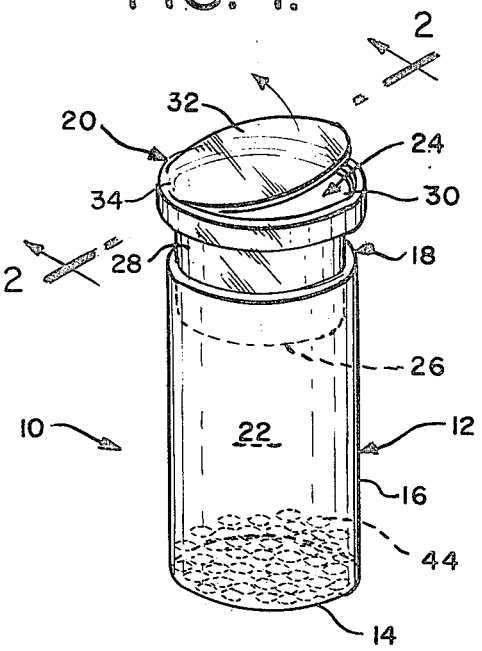
FIG. 1 is a front perspective view of one form of storage and individualized dosage container for pills, tablets or the like embodying the features of the invention.
Figure 2:
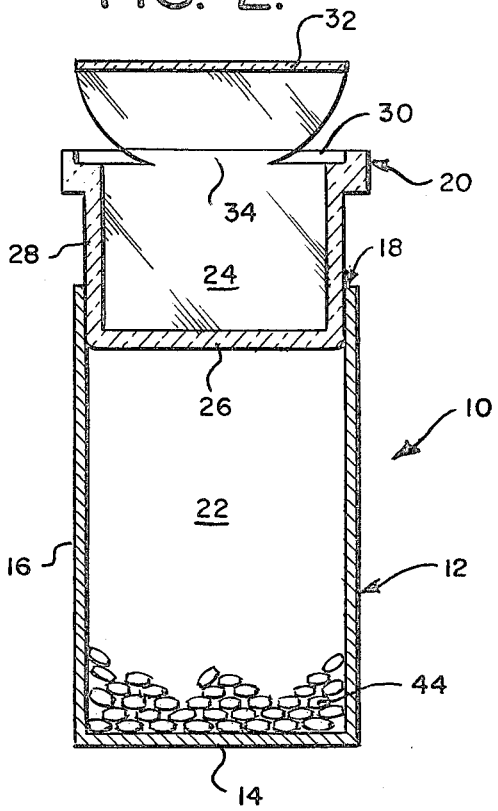
FIG. 2 is an elevational view in cross-section of the container shown in FIG. 1 taken along line 2—2 thereof.

Before explaining the invention in detail it is to be understood that the invention is not limited in its application to the details of construction and arrangement of parts illustrated in the drawings since the invention is capable of other embodiments and of being practiced or carried out in various ways. It is also to be understood that the phraseology or terminology employed is for purpose of description only and not of limitation.

Referring to the drawings, in which like parts have been similarly designated, there is shown a container and individualized dosage compartment assembly 10. The assembly consists of a receptacle 12 formed of a bottom wall 14 and sidewalls 16 which extend upwardly therefrom and terminate at their extremities in an open mouth 18. It will, of course, be appreciated that although the receptacle depicted has a smooth peripherally extending end portion the extremities of sidewalls 16 may take the form of a lip or flange to accommodate the lower end of a closure cap 20 to be described in greater detail such that when the closure cap is placed in seated relationship in or about the mouth of the receptacle the mouth will be sealed, desirably hermetically, against the surrounding environment. The adjacent end of the closure cap will naturally have a complementary configuration. The bottom and sidewalls of the receptacle define a chamber 22 therein of adequate volume to accommodate a quantity of pills, tablets, etc. for storage therewithin. Preferably the volume of the chamber is sufficiently large that it is capable of storing several times the quantity of pills, etc. which may be positioned within the compartment 24 of the closure cap 20.

The container assembly also includes closure cap 20 which compises a bottom wall 26 and sidewalls 28 projecting therefrom to define a compartment 24. As stated earlier, chamber 22 possesses a volume which is several times larger than that of compartment 24, the object being to allow for the storage of a relatively large supply of the pills or tablets, etc. to be consumed. The compartment 24, on the other hand, is dimensioned to accommodate only sufficient pills or tablets for one day or a portion of one day as desired and depending upon the number of pills prescribed per dosage.

The bottom and sidewalls of the closure cap are intended to serve as a plug seal for the receptacle; therefore, they should possess sufficient rigidity and be suitably proportioned to permit insertion into the receptacle. It is within the contemplation of the invention, however, to form the upper portion of the receptacle with a peripheral lip or flange as stated earlier. In such event the bottom and sidewalls of the closure cap need not function as a plug seal since a depending flange may be provided on the closure cap which cooperates with the rim or flange of the receptacle to effect the necessary sealing. Such constructions are well known and need not be described in detail herein.

An opening or mouth 30 is formed in the closure desirably at a location opposite to the bottom wall 26. Such opening may be of any appropriate size which will facilitate the placement of pills into compartment 24 and the withdrawal of the proper dosage of pills therefrom when required. Although opening 30 is illustrated in the drawings as being directly opposite from bottom wall 26 it will be recognized that the opening may be formed in sidewall 28.

The closure cap 20 includes a lid member 32 which is integral therewith. By integral it is meant that the lid is part of the closure cap in the sense that it remains with the closure cap even when it is moved to a position uncovering opening 30. In its preferred form the lid is formed as part of a one piece molded unit with the remainder of the cap and is connected thereto by means of a living hinge 34. In such form there is no risk that the lid will be misplaced when it is removed from the cap to expose compartment 24. FIGS. 1, 2, 3 and 5 depict such a lid. When the lid is to be provided in this form it, and the remainder of the closure cap, and if desired also the receptacle, are fabricated from a synthetic plastics material. Suitable materials include the polyacrylic and polystyrene resins which, when molded, produce a transparent member. It is preferred that at least a portion of the closure cap be transparent to facilitate inspection visually of the interior of compartment 24 to ascertain whether or not the prescribed dosage of pills within the compartment has been consumed. Thus, fabrication of the entire closure cap from a material which will result in transparency is an eminently satisfactory embodiment of the invention.

Figure 3:
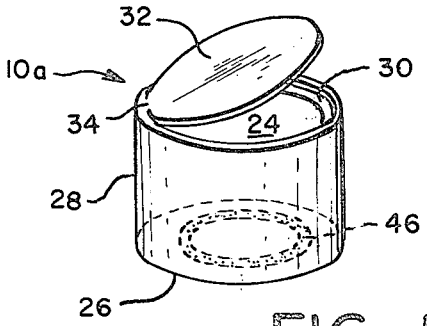
FIG. 3 is a perspective view of an individualized dosage compartment adapted to be adhesively securable to the closure of a container.

In FIG. 3 there is shown an individualized dosage container 10*a* which is similar to closure cap 20 previously described in that compartment 24 thereof is for storage of a dosage of pills or tablets. However, according to this embodiment the container 10*a* does not serve as the primary closure for receptacle 12 but rather is adhasively securable to the conventional closure for the receptacle and is removable from the receptacle therewith. Thus, as shown in FIG. 3 the bottom wall of the container 10*a* is provided with adhesive means 46, preferably in the form of an adhesive protected by peel off strips. When the container is to be applied to the top of the closure for the receptacle the strips are removed and the container 10*a* is adhesively secured to the closure. By this expedient a convenient dosage container is provided. It will, therefore, be understood that the expession closure cap as employed in the specification and claims is intended to be generic to those constructions where it serves as the closure for the receptacle and as represented by the embodiment of FIG. 3 where it is affixed to the receptacle closure.

Figure 4:
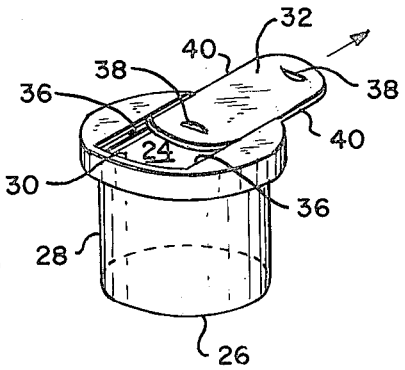
FIG. 4 is a perspective view of the upper end of a closure cap having a modified construction.

Another modified form of closure cap is illustrated in FIG. 4. There, it will be observed, the opening 30 is given a slotted configuration 36. The lid member 32 is configured and dimensioned to slide within slot 36 to selectively uncover or seal opening 30. One or more indentations 38 are desirably formed in the slide member to expedite movement thereof by one's thumbnail. The dimensions of the slide member are preferably chosen to insure a relatively snug fit between the walls of the slot and the longitudinally extending sides 40 of the slide member. In this manner the slide member will normally be confined within slot 36 although movable therewithin to seal or uncover opening 30.

Figure 5:
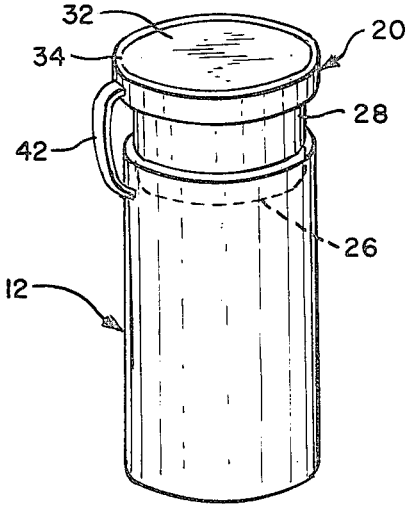
FIG. 5 is a perspective view of a container embodying the features of the invention in accordance with a further modification.

In FIG. 5 there is shown a closure cap 20 which itself is hingedly connected to the receptacle by hinge means 42 such that the entire cap is pivotable to permit selective sealing of the mouth of the receptacle or uncovering thereof while maintaining a unity of assembly between the closure cap and receptacle. Such a construction will insure that there can be no misplacement or loss of the closure cap.

In all of the views the contents of compartment 24 are shown as being pills or tablets 44 as are the contents of the receptacle. It will be appreciated, of course, that such contents may be capsules or other known forms of vitamins, medication, etc. conventionally obtained from drugstores, labs and the usual sources of supply.

Although the invention has been described in specific terms it will be understood that various changes may be made in size, shape, materials and in the arrangement of the parts without departing from the spirit and scope of the invention as claimed.

Having thus set forth the nature of the invention, what is claimed herein is:

1. A storage and individualized dosage container assembly for pills, tablets and the like comprising:

a hollow storage receptacle including a bottom wall and sidewalls which terminate in an open mouth;

and a closure cap comprising a bottom wall, sidewalls defining with said bottom wall a compartment dimensioned to contain pills, tablets and the like of the type stored within said receptacle but in a lesser quantity, the said closure cap being cooperable with said receptacle to selectively seal same, an opening being formed in said closure cap at a location remote from the bottom wall thereof, said closure cap provided with adhesive means on the bottom wall thereof cooperable with the top of a closure for said receptacle to be securable thereon, said closure cap being removable from said receptacle with said closure as a unitary member and a lid integral with the closure cap and movable selectively in relation to said opening therein between first and second positions in which the opening is respectively sealed and exposed to provide access to the contents of said compartment.

2. A container assembly according to claim 1 wherein at least a portion of said closure cap is formed of a transparent material.

* * * * *